United States Patent [19]

Ehrlund

[11] 4,121,004

[45] Oct. 17, 1978

[54] STRIP ROLL FOR USE IN DISPENSING TICKETS

[75] Inventor: Åke Ehrlund, Spånga, Sweden

[73] Assignee: AB Turn-O-Matic, Sundbyberg, Sweden

[21] Appl. No.: 520,865

[22] Filed: Nov. 4, 1974

Related U.S. Application Data

[62] Division of Ser. No. 326,457, Jan. 24, 1973, Pat. No. 3,885,724.

[51] Int. Cl.[2] ..... B65D 85/66

[52] U.S. Cl. ..... 428/43; 428/131

[58] Field of Search ..... 206/820, 390, 389, 409; 270/52; 283/12.1; 281/5, 12; 428/131-134, 43, 136; 225/106, 13; 40/2

[56] References Cited

U.S. PATENT DOCUMENTS

| | | | |
|---|---|---|---|
| 405,412 | 6/1889 | Hicks | 428/43 |
| 453,003 | 5/1891 | Hicks | 283/12.1 |
| 3,332,547 | 7/1967 | Rowe et al. | 206/390 |
| 3,467,250 | 9/1969 | D'Elia et al. | 206/820 |
| 3,583,558 | 6/1971 | Davis | 206/390 |

FOREIGN PATENT DOCUMENTS 598,710 5/1960 Canada.

*Primary Examiner*—Marion E. McCamish
*Attorney, Agent, or Firm*—Limbach, Limbach & Sutton

[57] ABSTRACT

A strip roll for use in an assembly for dispensing tickets is described which assembly has a tear-off device from which the end of the strip protrudes and wherein the roll comprises a strip of flexible material having a series of penetrated lines spaced longitudinally along the strip with each line shaped and adapted to form an individual tongue shaped flap defined by a line starting from one point adjacent to but spaced inwardly from one marginal edge of the strip, extending forwards in the feeding direction of the strip and towards the centerline thereof and on the other side of the centerline of the strip extending back to another point adjacent to but spaced inwardly from the other marginal edge of the strip. The flap which is dimensioned to be gripped for pulling the strip is connected to the strip along a straight line drawn between the two points, which straight line is perpendicular to the feeding direction of the strip. On the two sides of each flap between the end points of the penetrated line and the adjacent marginal edges, marginal strip portions connect all of the ticket pieces in the strip.

2 Claims, 6 Drawing Figures

FIG. 4
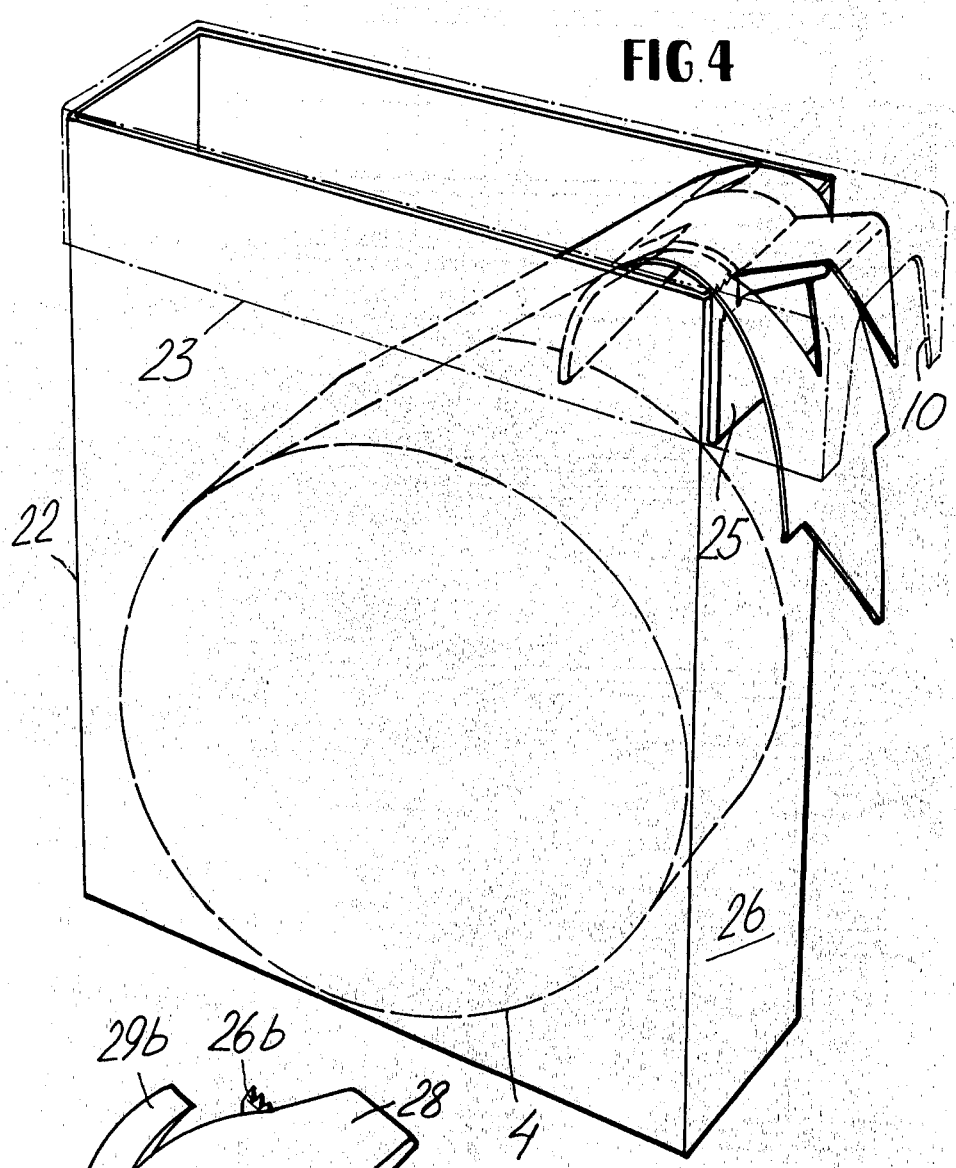
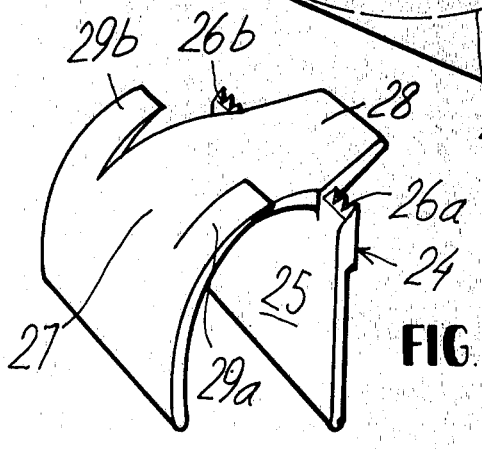
FIG. 5

STRIP ROLL FOR USE IN DISPENSING TICKETS

This application is a division of copending application Ser. No. 326,457 filed Jan. 24, 1973, now U.S. Pat. No. 3,885,724, issued May 27, 1975. This invention relates to appliances which comprise a strip provided with perforations or punched lines, which strip is fed forward and is torn off by means of a pull at that end of the strip which is at that time the free end.

However, such known appliances which are used primarily for the issue of queuing and similar tickets are not as reliable in operation as one has the right to expect.

The object of this invention has therefore primarily been the creation of a strip roll for a dispensing device which is particularly reliable in operation and also has a simple construction.

In order to accomplish these and other aims, the device is designed in accordance with the claims.

The invention is accomplished with a strip roll for use in an assembly for dispensing tickets and which assembly has a tear-off device from which the end of the strip protrudes. The strip roll comprises a strip of flexible material having a series of penetrated lines spaced longitudinally along the strip with each line shaped and adapted to form an individual flap defined by a line starting from one point adjacent to but spaced inwardly from one marginal edge of the strip extending forwards in the feeding direction of the strip towards the centerline thereof and on the other side of the centerline of the strip extending back to another point adjacent to but spaced inwardly from the other marginal edge of the strip. The flap which is dimensioned to be gripped for pulling the strip is connected to the strip along a straight line drawn between the two points, which straight line is perpendicular to the feeding direction of the strip. On the two sides of each flap between the end points of the penetrated line and the adjacent marginal edges marginal strip portions connect all the ticket pieces in the strip.

Three constructional versions of the invention are shown as examples in the attached drawings.

FIG. 4 shows in perspective a second constructional version of the invention, in which the casing and/or the cover may be of the throw-away type.

FIG. 5 shows in perspective a plastic component, most conveniently made by injection moulding, which forms part of the constructional version according to FIG. 4.

Figure 1:
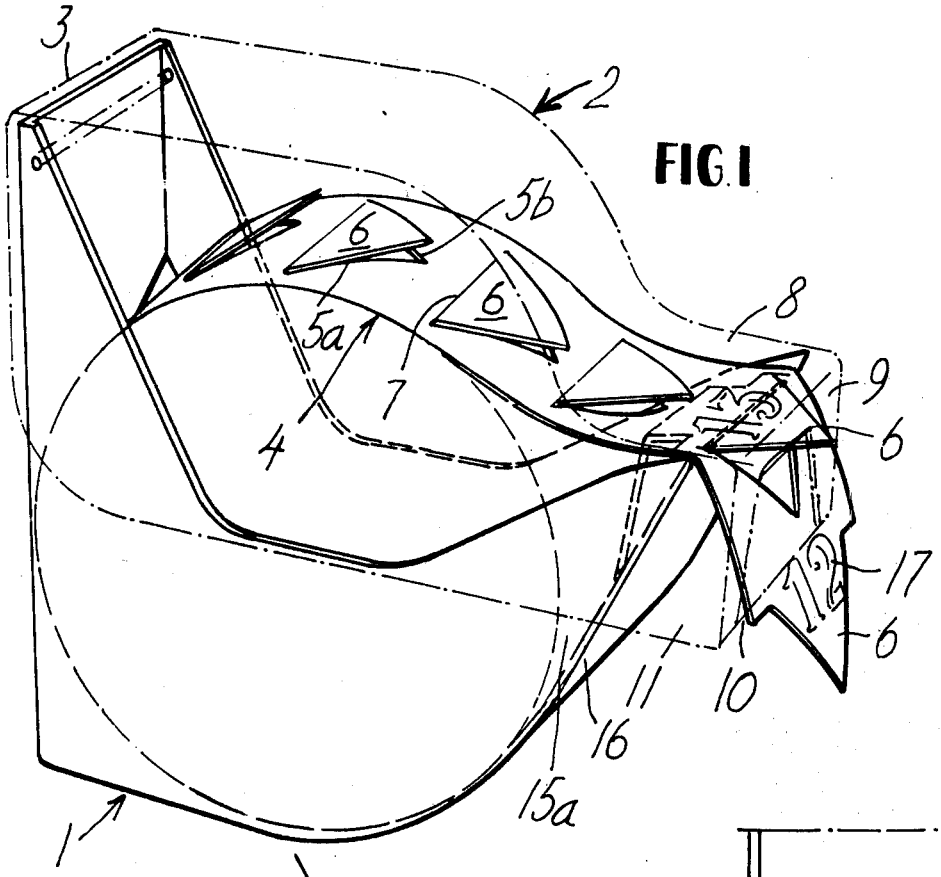
FIG. 1 shows a perspective view of a first constructional version of the invention, with the casing indicated by chain lines.

In the figures 1 denotes the casing of the appliance while 2 denotes a cover which is joined to the casing by means of a pivot 3, about which it may be raised and lowered. Together, the casing and the cover form at the side which is on the right in the Figure, a guide for the discharge of a flexible strip material or strip placed in the casing in the shape of a roll which has the general designation 4. This strip, which is most appropriately made of paper, is punched through along lines 5*a*, 5*b* at a regular spacing so as to form a number of flaps 6 which, as shown in the Figure, have the property that their width is least at the free end and largest at the end 7 which is connected to the rest of the strip. With this regular spacing each flap will be part of a different ticket piece or strip piece and the longitudinal spacing between corresponding portions of adjacent flaps will be equal to this regular spacing. The connected end 7 of each flap extends laterally of the strip perpendicular to the longitudinal direction of the strip and extends from a strip portion adjacent one marginal edge of the strip to a strip portion adjacent the other marginal edge of the strip with the marginal strip portions connecting the different ticket pieces of the strip. In this connection, it may be pointed out that it is not necessary for these flaps to be completely punched out as shown in the Figure, but that it is possible to replace the punched lines by lines of perforation.

The casing and the cover are constructed so that together they form a discharge and tear-off device for the strip. To this end, the cover 2 has a portion 8, the orientation of which may be parallel to a tangent to the roll which the strip 4 forms. This portion is connected to a portion 9 in which there is a slot 10 open at the bottom, which portion 9 is substantially at right angles to the portion 8 and is directed downwards. The portions 8 and 9 constitute one part of a guidance device for the strip.

Figure 2:
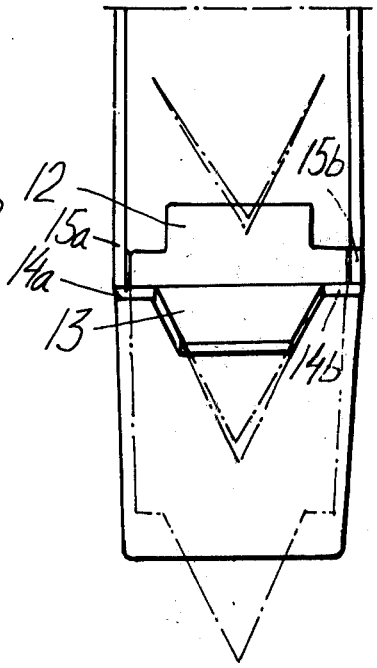
FIG. 2 shows the discharge portion of the casing, viewed from the free end of the strip, the cover being raised.

The second part of the said guidance device is formed by the casing which for this purpose exhibits a first portion 12 which, in the position in which the device is used, is substantially parallel to the portion 8 but is situated at some distance from this, so that there is between these parts a gap through which the strip can pass. The part 12, as seen in FIG. 2, is connected to a tongue 13 which is substantially an extension of the part 12. The greatest width of the tongue 13 which, as seen in the Figure, is appropriately wider at its base than at its free end, is less than the greatest width of the flaps 6. The tongue extends almost up to the inside of the portion 9 of the cover which is pointing downwards, i.e. in such a way that there is formed a gap through which the strip can pass. At its base, the tongue is connected by means of portions 14*a*, 14*b*, which are constructed as tear-off devices, to the side walls 15*a*, 15*b* of the casing which, together with the tongue 13, constitute the second portion of the said guide.

In the position in which it is used, the cover 2 is lowered over the casing as shown in FIG. 1. The strip has been passed through the horizontal guide formed by the surfaces 8, 12 and the upper parts of 15*a*, 15*b* and through the vertical guide formed by the surface 9, the end portion of the tongue 13 and guide projections, not shown, on the inside of the side faces 11 of the cover.

Figure 3:
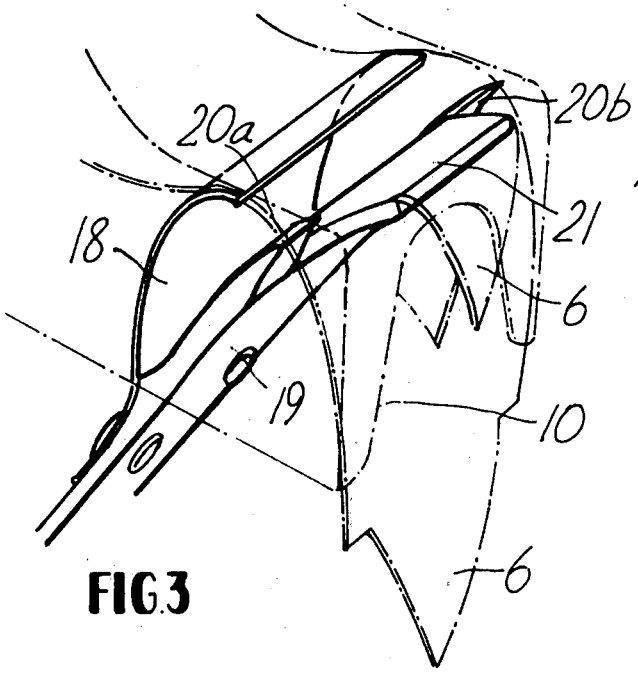
FIG. 3 shows a somewhat modified constructional version of the invention, the cover of the casing being indicated by chain lines.

When it is desired to tear off a queuing ticket, the clap 6 is to be gripped and the strip pulled downwards by means of this. The causes the strip to move first horizontally and then vertically. When the strip has been pulled forward so far that the width of the opening formed by the punched lines 5*a*, 5*b* exceeds the width of the tongue 13, the strip itself will be deflected in such a way that in its final position, as shown in FIG. 1, in which the width of the flap 6 is practically the same as that of the tongue 13 at its base, the strip is deflected about this base portion. It will be clear that, as the strip continues to be pulled downwards, it will be torn off by the cutting edges 14*a*, 14*b* provided for this purpose. If the slot 10 in the front wall of the cover had extended right up to the top of the cover, the flap 6 would not have been deflected but, as shown in FIG. 1, would have projected in the direction of the tangent. For the reliable operation of the device, however, it is important that the strip should be subjected to a downward pull, and for this reason the slot 10 ends some distance below the tongue 13, thus converring on the flap 6 its vertical orientation, e.g. as shown in FIG. 3. By virtue of the fact that there is a space between the front wall 16 of the casing and the inside of the front wall of the cover, the flap fed forward is readily accessible. When the queuing ticket, which thus consists of a flap 6 and strip material up to the next flap, has been torn off, the strip is again in its initial position and a new queuing ticket can immediately be drawn forward. Naturally, the strip can in a known manner be provided with the desired wording and a queuing number, ticket number or similar 17. It is also possible, for instance, to provide two flaps in the shape of right-angled triangles situated side by side and facing opposite ways, etc.

In the constructional version according to FIG. 3, the lower horizontal guide for the strip does not consist of continuous parts but is made up of a preferably resilient rear tongue 18 which is attached to the inside of the casing 1 or is made integral with this, and a front part 19 which is appropriately part of the front wall of the casing and comprises the cutting edges 20*a*, 20*b* corresponding to the edges 14*a*, 14*b* in FIG. 1 and a tongue 21 corresponding to the tongue 13, but, contrary to this, positioned at an angle. The upper parts of the tongues 18, 21 will thus form the bottom part of the horizontal guide for the strip. The cutting edges 20*a*, 20*b* are situated at a level below this. In this constructional version, especially if the tongue 18 is made of a resilient material, the tongue can abut onto the part 8, and by pressing the strip against this part 8, can give rise to a frictional force which prevents unintentional retraction of the strip into the casing.

The invention also makes possible production of discharge appliances at an extremely low cost, whereby the whole appliance or part thereof may consist of a throw-away article. Such a device, particularly designed for the sale of tickets at sporting and similar events, is shown in FIG. 4.

In this constructional version the casing consists of a simple cardboard box 22. This box at the same time serves as a container for the strip 4 which, as in the constructional version described earlier, is appropriately in the shape of a roll and is made in the same way. The box is closed by a cover 23 which extends outside the box and has a slot 10 in one of its end walls.

An injection moulded part 24 is attached to the cover and the two parts together serve as the guides for the strip. The component comprises a first flat portion 25 which is to abut onto one front wall 26 of the box. At the top of the flat portion 25, as shown in FIG. 5, there are two cutting edges 26*a*, 26*b* separated in the lateral direction, and between these the portion 25 is joined to a portion 27 which is bent in an are downwards and backwards, and a tongue (28) extending forwards and upwards. The arcuate portion 27 is provided with resilient projections 29*a*, 29*b* which are directed upwards and are also arcuate, the top parts of which are situated at approximately the same level as the top part of the tongue 28 and press the strip against the cover by a spring force. The cutting edges 26*a*, 26*b* are situated at a lower level. The method of operation of this device is in complete agreement with that described earlier.

Figure 6:
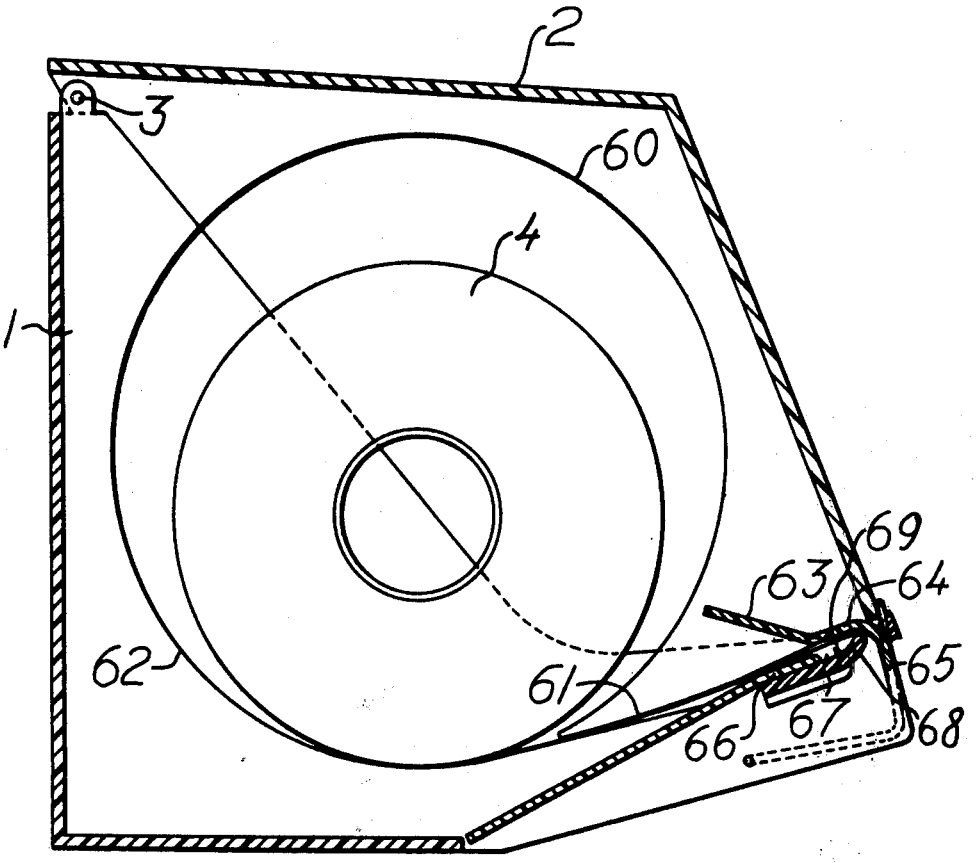
FIG. 6 shows in a side view and partly in section a third embodyment of the device according to the invention.

In the embodiments according to FIGS. 1 and 4 the strip roll is unrolled clockwise whereas in FIG. 6, the strip roll is unrolled counter-clockwize. The discharge device according to FIG. 6 has semicircular guide means 60, arranged inside the cover 2. The end 61 of said guide means 60 extend below the front end of said cover and form front stops for the strip roll. The casing 1 carries correspondingly formed guide means 62 and from FIG. 6 it is obvious that the strip roll rests against the guide means 62. Said guide means 60,62 constitute a support for the strip roll as well as limiting surfaces for said strip roll.

The discharge and cut off means for the strip according to the embodyment in FIG. 6 constitutes a portion arranged inside the front part of the cover 2 and consisting of a slightly directed, inner portion 63, transcending into a curved part 64 and terminating in a downwardly directed portion 65, extending below the front part of the cover 2. The guiding means arranged in the casing constitutes a inclined path 66 transcending in its front part into a upwardly directed tongue 68 via a shoulder 67. The tongue 68 has the generally shaping and function of e.g. the tongue 13 in FIG. 2, thus having edges 69 forming tear off devices.

The guiding means bear on or almost bear on the upside of the strip 4. A narrow discharge gap is formed between the guide means 65 of cover 2 and the upwards directed front part of the tongue 68. The function of this embodyment is exactly in accordance with the examples of FIGS. 1 and 4. Thus, by pulling the flap 6, the strip roll will be discharged and forces the strip, subject to the pulling force in such way, that said strip will automatically be torn off against the edges 69, simultaneously the flap of the next strip will be turned down due to the guide means 64, 65. When the first mentioned flap has been torn off, the flap of the next strip is uncovered and can easily be gripped.

The invention can naturally be varied also in other respects within the framework of the following claims.

I claim:

1. A strip roll for use in an assembly for dispensing tickets and which assembly has a tear-off device and from which the end of the strip roll protrudes comprising a strip of flexible material from which single pieces of one and the same predetermined length are intended to be torn off and having a pair of marginal edges and a feeding direction away from said roll, said strip having a series of longitudinally spaced apart penetrated lines, each of said lines shaped and adapted to form an individual tongue shaped flap, each of said lines starting from a point adjacent to but spaced inwardly of said strip from the first of said marginal edges and extending in said feeding direction of said strip toward the centerline thereof, and on the other side of said centerline extending back opposite said feeding direction of said strip to a point adjacent to but spaced inwardly from the second of said marginal edges of said strip, said flaps equally spaced longitudinally along said strip with the longitudinal spacing between corresponding portions of adjacent flaps equal to said predetermined length, the points at the ends of each of said penetrated lines lying on a straight line which is substantially perpendicular to the longitudinal direction of the strip and with each flap firmly connected to the remainder of said strip along said straight line between said points, the end of each of said flaps remote from said firmly connected portion having a width smaller than that of said firmly connected portion and with the smaller end of each flap directed forwards in said feeding direction of said strip and dimensioned to be gripped for pulling the strip and tearing a single end piece from said strip, and marginal strip portions at both sides of each flap between the end points of said penetrated line and the adjacent marginal edges of said strip and connecting all of said pieces of predetermined length in said strip, whereby when said end of said strip roll protruding from said dispensing assembly is pulled, the strip moves to place the marginal strip portions which are closest said protruding strip end at the tear-off device for severing the end piece of said strip and leaving the next adjacent flap protruding from the assembly.

2. A strip roll for use in an assembly for dispensing tickets and which assembly has a tear-off device and from which the end of the strip roll protrudes comprising a strip of flexible material from which ticket pieces are intended to be torn off and having a pair of marginal edges and a feeding direction away from said roll, said strip having a series of longitudinal spaced apart punched lines, each of said punched lines shaped and adapted to form an individual tongue shaped flap free at one end from the remainder of said strip and firmly connected with said strip at the other end, each of said punched lines starting from a point adjacent to but spaced inwardly of said strip from the first of said marginal edges, extending in said feeing direction of said strip and toward the centerline of said strip, and on the other side of said centerline extending back opposite said feeding direction of said strip to a point adjacent to but spaced inwardly from the second of said marginal edge of said strip, the points at the ends of each of said punched lines lying on a straight line which is substantially perpendicular to the longitudinal direction of said strip and with the connection of the adjacent flap to the strip located along said straight line between said points, the free end of each of said flaps having a width smaller than that of said firmly connected portion and with the smaller end of each flap directed forwards in said feeding direction of said strip and dimensioned to be gripped for pulling the strip and tearing a single end piece from said strip, and marginal strip portions at both sides of each flap between the end points of said punched line and the adjacent marginal edges of said strip and connecting all of the ticket pieces in said strip, whereby when said end of said strip roll protruding from said dispensing assembly is pulled, the strip moves to place the marginal strip portions which are closest said protruding strip and at the tear-off device for severing the end ticket of said strip and leaving the next adjacent flap protruding from the assembly.

* * * * *